United States Patent [19]

Thoma

[11] 4,153,967

[45] May 15, 1979

[54] ROTATABLE BRUSH FOR A SHAMPOOER-POLISHER

[75] Inventor: Hans Thoma, Schallstadt-Wolfenweiler, Fed. Rep. of Germany

[73] Assignee: Weiler Bürsten GmbH, Schallstadt-Wolfenweiler, Fed. Rep. of Germany

[21] Appl. No.: 861,638

[22] Filed: Dec. 19, 1977

[30] Foreign Application Priority Data

Dec. 20, 1976 [DE] Fed. Rep. of Germany ..... 7639765

[51] Int. Cl.[2] ..... A46B 9/06; A46B 13/02

[52] U.S. Cl. ..... 15/181; 15/DIG. 5; 15/DIG. 6

[58] Field of Search ..... 15/179–183, 15/230.13, DIG. 5, DIG. 6; 29/124, 125, 130, 131; 51/334–337, 181 R

[56] References Cited

U.S. PATENT DOCUMENTS

| | | | |
|---|---|---|---|
| 553,402 | 1/1896 | Goulding et al. | 15/181 |
| 648,166 | 4/1900 | Farnham | 15/181 |
| 649,289 | 5/1900 | Farnham | 15/181 |
| 3,599,264 | 8/1971 | Smith, Jr. | 15/181 |
| 3,643,281 | 2/1972 | Schofield | 15/181 |

FOREIGN PATENT DOCUMENTS

| | | |
|---|---|---|
| 117183 | 12/1899 | Fed. Rep. of Germany. |
| 463268 | 4/1951 | Italy. |
| 1238227 | 2/1971 | United Kingdom. |

*Primary Examiner*—Peter Feldman

*Attorney, Agent, or Firm*—Michael J. Striker

[57] ABSTRACT

A rotatable brush has a synthetic resin and wood hub defining an axis. At least two complementarily shaped mounting rings are integrally connected with and extend radially from the hub. Each mounting ring has an outer rim, and the rings are heat sealed together. An array of radially extending bristle tufts is carried on each of the outer rims.

9 Claims, 3 Drawing Figures

ROTATABLE BRUSH FOR A SHAMPOOER-POLISHER

BACKGROUND OF THE INVENTION

This invention relates to substantially circular polishing and cleaning brushes which have adjacent parallel rows of bristle tufts fixed to a plastic annular mounting connected to a drive shaft by, for example, a threaded spindle.

The problem of the conventional art arises from the complexity involved in making such brushes from synthetic resin. A number of different die molds are required in order to produce brushes having mountings of varying axial length and having a varying numbers of rows of bristle tufts.

The production of brushes is further complicated when it is desired to separate individual rows of bristles with a disk of polishing material of nettle cloth, felt, leather or the like.

SUMMARY OF THE INVENTION

A purpose of the invention is to provide a simply produced rotatable brush in which the axial length of the mounting may be varied along with the number of parallel rows of bristles.

Another object of the invention is to provide a rotatable brush which is readily adaptable to the insertion of polishing material into the mounting, and in which the polishing material can be inserted without changing the injection-molding equipment used to produce the inventive synthetic resin brush.

In accordance with the inventive concept, the mounting is formed of a plurality of coaxially interfitting mounting rings of synthetic resin. These mounting rings each have an outer rim and an inner periphery. The mounting rings are heat sealed together, and are fixed at their inner peripheries to the outer periphery of a hub which defines an axis.

A readily apparent advantage of this invention is that a desired axial length for a mounting can be achieved by merely fitting together enough prefabricated mounting rings to collectively extend the desired length.

The mounting rings are advantageously designed in such a manner that one basic form interfits with another and all of the basic shapes have substantially the same inner periphery. It has been found that the mounting rings need only have three basic forms on the basis of which the mounting rings could be interfitted ad infinitum. Two separate forms are advantageously designed for each end. One end will have an axially extending male part, the other will have an axially extending female part. The third form is designed in such a manner that one side has an axially extending male part fittable into the female part of the respective end, and the opposite side has an axially extending female part with which the male part of the other end is engageable. The third form is also so designed that a plurality of third forms can be interfitted without diminishing the effective inner periphery — simply by fitting the side having the male part into the conversely shaped side of another third form.

In a particularly useful embodiment, polishing material is inserted between a designated number of rows. This is accomplished by providing an annular disk of polishing material which extends radially from an inner periphery which is at least substantially the same as that of each of the mounting rings. The male part of a mounting ring is passed through this inner periphery of the polishing material disk. As the male part extends to the female part of another form and interlocks, the polishing material is pressed between two forms. The insertion is done very easily and without any adverse effect or interruption of a die casting process.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 3 is an exploded view of the embodiment shown in FIG. 2.

DETAILED DESCRIPTION OF A PREFERRED EMBODIMENT

Figure 1:
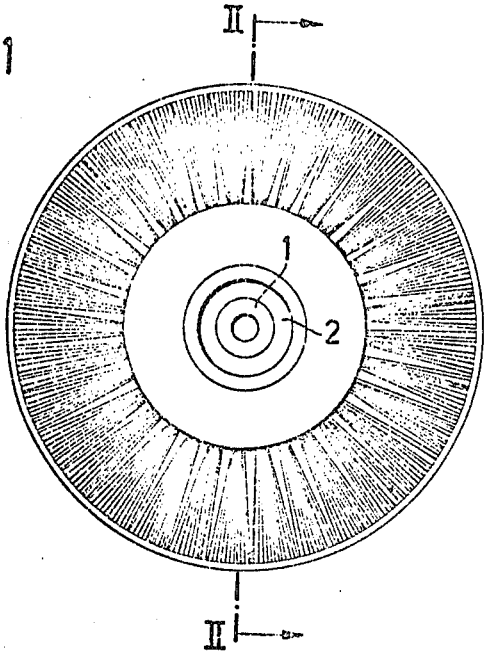
FIG. 1 shows a face of the inventive rotating brush.

The rotatable brush illustrated by the drawing is connectable to the drive shaft of a shampooer-polisher, the brush being mounted on a threaded drive spindle. A centrally located wood socket or sleeve 1 is threaded onto the threaded drive spindle. The wood socket 1 is surrounded by a cylindrical hub 2, which consists of synthetic resin. A mounting 3 also made of synthetic resin is fixed to hub 2. The mounting 3 has parallel adjacent rows of bristle tufts 4. Between the rows, a polishing material disk 5, for example of nettle cloth, felt or leather, is arranged, so as to extend outwardly beyond the rows of bristle tufts 4 (see FIG. 2).

As shown in FIG. 3, mounting 3 consists of a plurality of coaxial, interfitting, disk-shaped mounting rings 31, 32, 33. Mounting ring 31 serves as one end, and extends radially about an axis A defined by the inner periphery (at 34) of the mounting ring. Mounting ring 31 also has an outer rim 39 to which at least one row of bristle tufts 4 is fixed. The side not intended for interlocking may be planar, or, as is shown here, frustoconical. But the mounting ring side which is intended for interfitting is provided with a male part 37 extending axially along axis A and radially about the axis A so as to define a circular aperture having the same inner periphery as the rest of mounting ring 31. However, the outer periphery of male part 37 is considerably smaller in dimension than the outer rim 39. Between outer rim 39 and the beginning of male part 37 is an annular stepped portion or groove half 41.

Mounting ring 32 includes a portion coaxial with and having the same inner periphery at 35 as mounting ring 31. This portion is provided with a male part 37 substantially the same as the male part 37 of mounting ring 31. Between the outer rim 39 of mounting ring 32 and male part 37 of the same ring 32 is an annular stepped portion 41 — also substantially the same as the corresponding portion of mounting ring 31. This side of mounting ring 32 is intended to interfit with the female part of mounting ring 33.

Also, on the opposite side of mounting ring 32 is a female part 38 which is recessed into about $\frac{7}{8}$ of mounting ring 32 so that a circular recess is formed and has a larger diameter than the inner peripheries 34, 35 of mounting rings 31 and 32 respectively. The female part 38 is complementary to the male part 37 of mounting ring 31 so when they interlock, the two mounting rings 31 and 32 have collective inner periphery which is the same as that of mounting ring 31 or the male part-equipped side of mounting ring 32. An annular stepped portion 42, is also present on the female part-bearing side of mounting ring 32. Stepped portion 42 is of the same dimension as stepped portion 41 of mounting ring 31.

As male part 37 of ring 31 interlocks with female part 38 of ring 32, a polishing-material disk 5 is pressed between them in the groove existing between the pressed-together annular portions 41 and 42.

Figure 2:
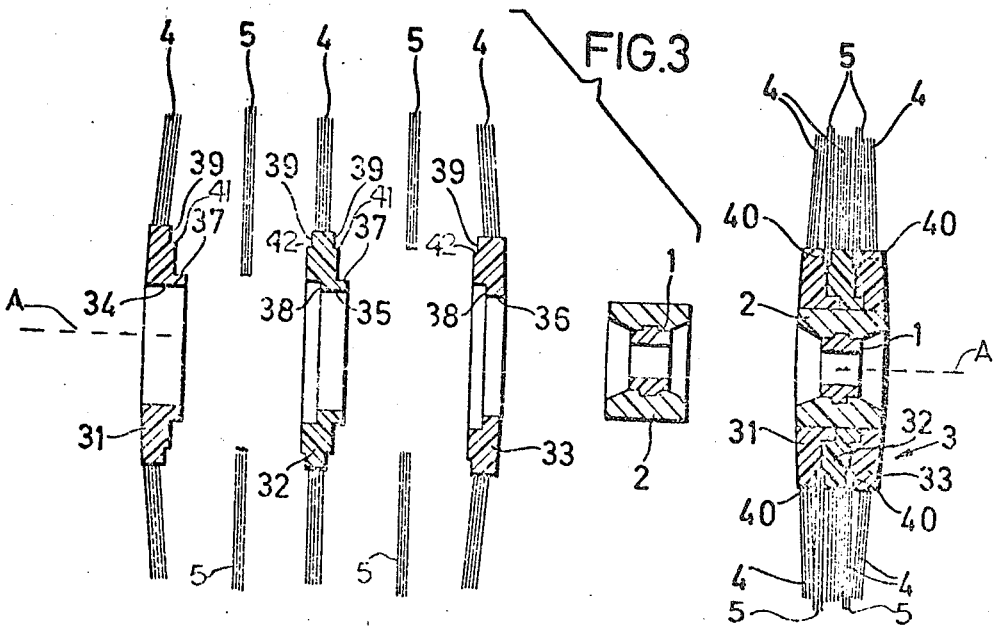
FIG. 2 is an axial view taken in line II—II of FIG. 1.

While at least one row of tufts 4 extend radially from outer rim 39 of ring 32, the tufts 4 of ring 31 extend radially and are slightly inclined in direction towards member ring 32. These differently directed tufts 4 are separated by polishing material 5, as is best shown in FIG. 2, where the polishing material 5 projects beyond the radial extent of the tufts 4.

Mounting ring 33 is designed as the other end piece. The side not intended for interfitting may be planar, or, as shown here, frustoconical. The opposite side is equipped with a female part 38 coaxial with and of substantially the same dimension as female part 38 of ring 32. An annular stepped portion 42 is provided and is substantially of the same dimension and orientation as portion 42 of ring 32. At least one row of tufts 4 is provided on rim 39; the tufts 4 are inclined in the direction of the female part 38 of ring 33 while extending radially from the outer rim 39 of ring 33. Inner periphery 36 of the planar or curved side of ring 33 is coaxial with and of the same dimension as inner peripheries 34 and 35. The second polishing-material disk 5 is sandwiched between annular portions 41 and 42 (shown as 40 in FIG. 2) as male part 37 of ring 32 engages female part 38 of ring 33.

Mounting ring 32 can be coupled with another similar ring; however, mounting ring 31 has only a male part so it can engage only a form with female part, while mounting ring 33 has only a female part and can only interfit with a form having a male part. By coupling forms together, the axial length of the mounting can be increased ad infinitum. Into the inner periphery 34, 35, 36 of the fitted-together mounting component, plastic hub 2 with its wooden socket 1 is inserted.

Then the mounting rings 31, 32, 33 and hub 2 are ultrasonically welded together to form the inventive rotatable brush.

As shown in FIGS. 2 and 3, each mounting ring 31, 32 and 33 has only a single row of synthetic-resin bristle tufts 4, and the tufts 4 of end rings 31 and 33 are inclined towards each other and are separated in spaces 40 (between stepped portions 41 and 42) by polishing material 5.

It will be understood that each of the elements described above, or two or more together, may also find a useful application in other types of rotatable brush differing from the types described above.

While the invention has been illustrated and described as embodied in constructions, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A rotatable brush, particularly for a champooer-polisher and the like, comprising a hub defining an axis, at least two mounting rings each having an inner periphery rigidly connected to said hub, an outer rim, and formations on the axial faces of the rings, said formations being complementary and axially interchangeable, said rings being welded to one another when in assembly with said hub and defining at least one radially outwardly open annular groove between the corresponding formations of two rings, respectively; an array of radially extending bristle tufts of a first material on each of said outer rims extending outwardly from said rings by a first predetermined distance; and at least one polishing element of a second material different from said first material fixedly inserted in each of said annular grooves between the corresponding formations of two rings and extending radially outwardly from said rings by a second predetermined distance exceeding said first predetermined distance.

2. The brush defined in claim 1, wherein said inner peripheries are of substantially the same diameter relative to said axis.

3. The brush defined in claim 1, wherein said hub includes an inner wooden portion centered on said axis and an outer synthetic-resin portion coaxially surrounding said inner wooden portion.

4. The brush defined in claim 1, wherein said formations include complementary male and female formations, said brush including a third such mounting ring having a respective array of bristle tufts, two of said mounting rings constituting end rings and sandwiching the third mounting ring which constitutes an intermediate ring, one of said end rings having one of said female formations and the other of said end rings having one of said male formations, said intermediate rings having oppositely effective male and female formations, whereby said male formation of said intermediate ring fits into said female formation of said one end ring and said female formation of said intermediate ring interfitting with said male formation of said other end ring.

5. The brush defined in claim 4, wherein said male formations are each constituted as a cylindrical projection at the respective inner periphery and centered on said axis, said female formations each being constituted by an annular axially open recess.

6. The brush defined in claim 1, further comprising at least one flat annular disk of nonrigid material centered on said axis and sandwiched between said rings.

7. The brush defined in claim 6, wherein said tufts of each of said disks are inclined radially outwardly from a plane perpendicular to said axis toward the other disk, whereby said disk is held between the oppositely inclined tufts.

8. The brush defined in claim 1, wherein said rings and at least part of said hub are of synthetic-resin material and are heat-sealed together.

9. The brush defined in claim 1, wherein said hub has an overall axial length substantially equal to the combined axial lengths of said rings when interfitted.

* * * * *